United States Patent [19]

Haas

[11] 4,087,027

[45] * May 2, 1978

[54] AEROSOL CAN ATTACHMENT

[76] Inventor: Edwin J. Haas, 17004 Pearldale Ave., Cleveland, Ohio 44135

[ * ] Notice: The portion of the term of this patent subsequent to Sep. 23, 1992, has been disclaimed.

[21] Appl. No.: 758,016

[22] Filed: Jan. 10, 1977

Related U.S. Application Data

[63] Continuation of Ser. No. 644,114, Dec. 24, 1975.

[51] Int. Cl.[2] ..... B65D 83/14

[52] U.S. Cl. ..... 222/402.13

[58] Field of Search ..... 222/402.1, 402.11, 402.12, 222/402.13, 402.15, 402.20, 509, 518

[56] References Cited

U.S. PATENT DOCUMENTS

| | | | |
|---|---|---|---|
| 3,221,946 | 12/1965 | Riley | 222/509 X |
| 3,231,150 | 1/1966 | Holm et al. | 222/518 X |
| 3,658,214 | 4/1972 | Beard | 222/402.2 |
| 3,777,946 | 12/1973 | Livingstone | 222/402.2 |
| 3,858,762 | 1/1975 | Meshberg | 222/509 X |
| 3,907,175 | 9/1975 | Haas | 222/402.13 |
| 3,912,131 | 10/1975 | Friedman et al. | 222/402.1 |
| 3,915,353 | 10/1975 | Haas | 222/402.1 |

*Primary Examiner*—Allen N. Knowles
*Assistant Examiner*—Fred A. Silverberg
*Attorney, Agent, or Firm*—Baldwin, Egan, Walling & Fetzer

[57] ABSTRACT

A novel actuator is provided for use on a pressurized aerosol can which provides a circular actuator disk concentric around the standard centrally located liquid outlet for such an aerosol can, the actuator disk having a central downwardly extending projection of a diameter to snugly embrace a standard spray head commonly attached to the outlet tube of an aerosol can. Two modifications show a compression spring held between the spray head and the actuator disk.

1 Claim, 4 Drawing Figures

AEROSOL CAN ATTACHMENT

Figure 1:
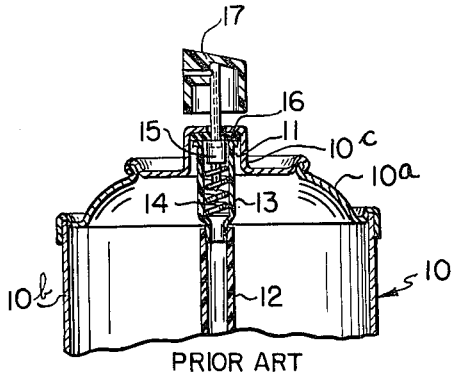
PRIOR ART FIG.1

This application is a continuation of my pending application, Ser. No. 644,114, filed Dec. 24, 1975, for Aerosol Can Attachment.

An object of the present invention is to provide a simple dispenser attachment which may be readily applied to and used with a standard aerosol can commonly found in the marketplace. It comprises a cheaply and easily constructed actuator disk with means for attaching the underside of the disk to an aerosol can outlet or spray head.

Figure 2:
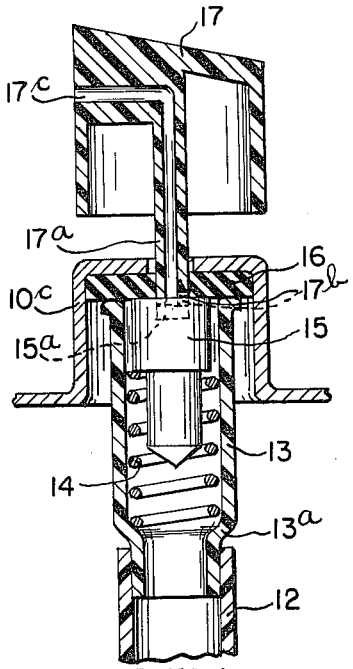
PRIOR ART FIG.2
Figure 3:
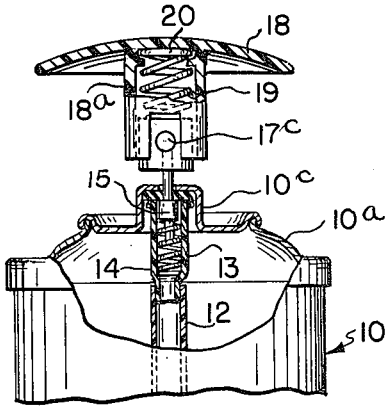
Figure 4:
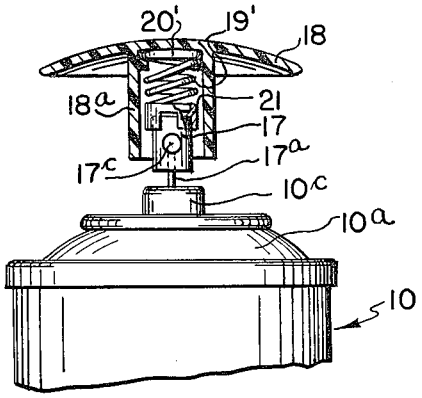

Other objects and advantages of the invention will be apparent from the drawings and description and the essential features will be set forth in the appended claims. In the drawings, FIG. 1 is a central sectional view of the upper portion of a cylindrical aerosol can equipped with a known form of actuator and valve used to discharge the contents of an aerosol can which is shown at the top of the view;

FIG. 2 is a central sectional view, enlarged, of the valve structure of FIG. 1 used in this invention;

FIG. 3 is a view partly in central section showing an embodiment of the invention wherein the spray head involves a male member which projects down into the outlet tube passageway from the can to effect release of the can contents by pressure axially of the outlet tube; while FIG. 4 is an elevational view, partly broken away in central section, showing another embodiment of the invention wherein the actuator disk and its downwardly extending attachment are arranged to at least partially embrace a standard spray head commonly applied to aerosol cans.

Referring to FIG. 1, there is shown a cylindrical pressurized tubular can 10 having a top 10a and an elongated body 10b connected between the top and bottom in an air-tight manner.

In a known manner, a control valve structure 11 is provided in said can fixed below the top of the can and having a liquid inlet tube 12 extending from the control valve to a zone adjacent to the bottom of the can, and having a liquid outlet tube portion 13 of predetermined diameter extending axially of the can in an air-tight manner through the top of the can. The valve structure shown in FIGS. 1 and 2 is a known structure commonly in use today. Resting upon the shoulder 13*a* of the tube portion 13 is a helical compression spring 14 which holds a small valve member 15 tightly against a flexible sealing gasket 16 which fits snugly in the central cylindrical projection 10c of the top 10*a*. The valve actuator comprises a plastic head 17 having an integral downwardly extending outlet tube 17*a* which is central of the head 17 and which bends at right angles to discharges at 17*c* when the discharge valve is actuated. The tube 17*a* is a tube having solid walls except for a very narrow slot 17*b* at one location at the bottom edge of the tube 17*a* and extending for just a fraction of an inch above the bottom of the tube 17*a* as clearly seen in FIG. 2. The lower portion of the tube 17*a* fits fairly snugly in a receiving depression 15*a* in the valve member 15. In the position of the parts shown in FIG. 2, the liquid material in the can 10 cannot escape through the tubes 12 and 13 because the spring 14 pushes the valve 15 tightly against the sealing gasket 16. However, when pressure is applied on the actuator head 17 axially of the tube 17*a*, then the tube 17*a* moves downwardly slightly into the depression 15*a* and the tube 17*a*, pushing downwardly on the valve 15, opens the narrow slot 17*b* and allows liquid from the can to escape between the valve 15 and the seal 16 through the slot 17*b* and to escape at the outlet 17*c*.

Referring now to FIG. 3, an actuator disk 18 is provided,integrally connected therewith, a downwardly projecting cylindrical tubular projection 18*a* of a diameter to snugly embrace the spray head 17. A helical compression spring 19, fitting within the projection 18*a*, is snapped into a snap ring 20 integral with disk 18, at its upper end, in position to engage the actuator head 17 when the device is placed over the structure described in FIGS. 1 and 2. Operation of the structure of FIG. 3. is as follows. The operation presses on the actuator disk 18 exerting a force axially downwardly in line with the outlet tube 17*a* which compresses the spring 19 sufficiently to cause the tube 17*a* to move downwardly from the position of FIG. 2 to depress the valve member 15 which releases the contents of the can to pass through tubes 12 and 13 and between the valve 15 and the seal 16 through the slot 17*b* to be discharged at the outlet 17*c*.

Another embodiment of the invention is shown in FIG. 4 where the actuator 18 and the tubular central projection 18*a* are like those described in connection with FIG. 3. Here spring 19' os snapped into a hollow disk 20' integral with and centrally of the actuator 18 and snapped into the top of a downwardly opening cup 21 at the lower end of the spring. This cup snugly engages the actuator head 17, as seen in FIG. 4. Here again, depression of the actuator 18 axially in line with the tube 17*a* will cause the tube 17*a* to depress the valve 15 and enable the discharge of the contents of the can through the outlet 17*c*.

If desired the parts 17, 18, 18*a*, 19 and 20 of FIG. 3 could be made as an assembled unit and the parts 17, 18, 18*a*, 19', 20' and 21 could likewise be made as an assembled unit.

The attachment between 19 and 20 in FIG. 3, and between 19' and 20' or 19' and 21 in FIG. 4, could comprise a projection centrally of the spring, over which the spring snaps.

What is claimed:

1. An aerosol dispenser attachment for use with a cylindrical pressurized tubular can having a top and a bottom and an elongated body connected between them in an air-tight manner and with a control valve structure in said can fixed below the top of said can and having a liquid inlet tube extending therefrom to a zone adjacent the bottom of said can and having a liquid outlet tube of predetermined diameter extending axially of said can in an air-tight manner to the top of said can, said control valve structure including a flexible seat mounted on the underside of the top of said can opposite said outlet tube, there being a central opening through said seal, said outlet tube fitting upwardly tightly against the seal of said control valve structure and said structure including a movable valve member normally closing against said seal such that pressure downward axially of said outlet tube releases pressurized liquid from said can through said valve and outlet tube; a first helical compression spring having an outside diameter fitting snugly in said outlet tube and supported in said outlet tube effective on said control valve to urge the same upwardly; and a spray head generally cylindrical having a short tube concentric with said spray head and having a single inlet at its lower end of a diameter snugly fitting downwardly into said central opening of said valve seal and extending at its upper end radially outwardly in said spray head to a discharge point in the periphery of said spray head; the combination therewith of a circular actuator disk, a downwardly projecting cylindrical tubular projection concentric with said disk and rigidly connected therewith and of a diameter to snugly embrace said spray head, said cylindrical tubular projection being cut away at the bottom to expose said discharge point when said control valve is opened, a second compression spring held in said tubular projection between said actuator disk and said spray head, and the parts being so arranged that pressure on said actuator disk axially of said outlet tube will compress said second compression spring sufficiently to compress said first compression spring and to cause short tube to press on said control valve structure and release the contents of said can to flow through said outlet tube and said short tube and said spray head to said discharge point.

* * * * *